United States Patent [19]

DiDomenico

[11] Patent Number: 4,526,154

[45] Date of Patent: Jul. 2, 1985

[54] TIMING CONTROL MECHANISM FOR A FUEL INJECTION PUMP

[75] Inventor: Robert A. DiDomenico, Ludlow, Mass.

[73] Assignee: AMBAC Industries, Incorporated, Springfield, Mass.

[21] Appl. No.: 453,854

[22] Filed: Dec. 27, 1982

[51] Int. Cl.[3] ..... F02D 1/02; F02M 45/00

[52] U.S. Cl. ..... 123/502; 123/450; 417/462; 417/221

[58] Field of Search ..... 123/502, 501, 500, 450; 417/462, 221

[56] References Cited

U.S. PATENT DOCUMENTS

| | | | |
|---|---|---|---|
| 3,869,226 | 3/1975 | Sosnowski | 123/502 |
| 4,033,310 | 7/1977 | Nicolls | 123/502 |
| 4,329,961 | 5/1982 | Johnston | 123/502 |
| 4,367,714 | 1/1983 | DiDomenico | 123/449 |
| 4,419,054 | 12/1983 | Sosnowski | 123/502 |

*Primary Examiner*—Charles J. Myhre
*Assistant Examiner*—Carl Stuart Miller
*Attorney, Agent, or Firm*—Stephen A. Schneeberger

[57] ABSTRACT

An improved timing control mechanism is provided for an engine-driven fuel injection pump of the type having plungers actuated by an adjustable cam. The cam is adjusted by the linear displacement of a timing piston operating in a cylinder. A pressurized hydraulic fluid admitted to a pressure chamber at one end of the cylinder provides a force against one end of the timing piston which is opposed by a biasing element, such as a spring. A rotary servo valve extends into an axial bore in one end of the timing piston for controlling the flow of hydraulic fluid through a control orifice formed in the wall of the piston bore and connecting with the cylinder's pressure chamber. The servo valve is axially fixed and includes an inclined, typically helical, control edge. Upon rotation of the valve, as by an electric rotary stepper motor, the control edge effectively moves "axially" relative to the control orifice to vary flow therethrough and thus cause the piston to track that "axial" positioning of the control edge. The valve's control edge is so positioned relative to its flow-occluding surface as to compensate for destabilizing forces transmitted to the timing piston through the cam.

9 Claims, 2 Drawing Figures

TIMING CONTROL MECHANISM FOR A FUEL INJECTION PUMP

DESCRIPTION

1. Technical Field

This invention relates to a timing control mechanism for a fuel injection pump, and more specifically to an improvement in such timing control mechanisms which employ an electric actuator for controlling the positioning of a timing piston within a timing cylinder.

2. Background Art

Fuel injection pumps, of the type disclosed, for example, in U.S. Ser. No. 226, 441, now U.S. Pat. No. 4,367,714, for "Fuel Injection Pump" filed Jan. 19, 1981 by Robert A. DiDomenico, John B. Cavanaugh and John A. Kimberley, and assigned to the assignee of the present invention, is adapted to deliver metered charges of fuel under high pressure sequentially to the cylinders of an associated engine in timed relationship therewith. In a pump of the aforementioned type, a cam ring having inwardly directed cam lobes surrounds one or more pump plungers. The pump plungers are movable by and relative to the cam lobes for translating the contour of the cam lobes into a sequence of pumping strokes producing the high pressure charges of fuel to be delivered to the engine.

The angular position of the cam ring is normally adjustable by means of a timing advance mechanism to regulate the timing of injection into the cylinders of the engine, typically as a function of engine speed. Such a timing advance mechanism may be hydraulically actuated as shown, for example in the aforementioned U.S. application Ser. No. 226,441 or, it may be manual-hydraulically actuated as shown, for example, in U.S. Pat. No. 3,869,226 entitled "Fuel Pumping Apparatus" issued Mar. 4, 1975 to Stanislaw Jan Antoni Sosnowski or, it may be electro-hydraulically actuated as shown, for example in U.S. Pat. No. 4,033,310 entitled "Fuel Pumping Apparatus with Timing Correction Means" issued July 5, 1977 to Wilfrid E. W. Nicolls or in U.S. Pat. No. 4,329,961 entitled "Diesel Injection Pump Timing Control with Electronic Adjustment" issued May 18, 1982 to Laird E. Johnston.

In each of the aforementioned timing advance mechanisms, a timing piston, housed within a timing cylinder, engages the annular cam ring such that linear movement of the timing piston within its cylinder results in rotation of the cam ring. In the aforementioned DiDomenico et al application, the timing piston is moved only in response to hydraulic forces developed as a function of engine and pump speed. In the aforementioned Sosnowski patent, the primary positioning of the timing piston is determined by the pump speed-dependent hydraulic pressure and a spring-biased servo-valve which constitute a follow-up servo-system. A further or secondary degree of timing control is provided by forming the servo-valve with contoured lands such that manual rotation of the servo shaft varies the axial position of the control edge of the servo lands. The servo lands may be of helical form to effect continuous adjustment of the axial position of the piston as the servo valve is moved angularly. It would be appreciated that such mechanism is relatively complex, that the setting of the piston is always dependent on the magnitude of the control pressure, and that only manual adjustment is contemplated.

In the aforementioned Nicolls patent, the timing advance mechanism employs a relatively simple follow-up hydraulic servo-system in which a torque motor directly controls the axial positioning of a landed servo-valve member within a bore in the timing piston. Axial displacement of the servo-valve is effected by an axially-moving drive member which extends from the torque motor through appropriate seals and into the hydraulic environment of the timing cylinder. Characteristically, the seals and sealing arrangements necessary for suitable long term sealing of such linear reciprocating motion are relatively complex, particularly in comparison to the rotary driver operating in the same general environment.

The earlier-mentioned Johnston patent discloses a system in which an electronically controlled rotary stepper motor provides a rotary input for controlling the positioning of a servo piston. That rotary input permits the use of relatively inexpensive and long lived sealing techniques where the rotary drive enters the timing cylinder. On the other hand, that rotary input is then translated to linear motion, via an additional translating mechanism, for controlling the axial displacement of the servo piston. Moreover, that timing mechanism employs not only a control timing piston, but a power piston as well within the timing cylinder. The speed-dependent hydraulic pressure provides the basic timing control, with the input from the rotary stepper motor providing a secondary mode of control.

Accordingly, it is a principal object of the present invention to provide an improved fuel injection pump timing control mechanism which is of relatively simple and durable construction and affords primary control of the timing piston through use of an electric rotary actuator operating a servo-valve.

DISCLOSURE OF THE INVENTION

In accordance with the present invention there is provided an improved timing control mechanism for an engine-driven fuel injection pump of the kind having one or more plungers located within respective bores and including an adjustable cam for effecting movement of the plungers. The timing control mechanism includes a fluid pressure operable timing piston for adjusting the setting of the cam to control injection timing. The timing piston operates within a timing cylinder and fluid is applied to an end of the cylinder for applying a force in one direction on an end of the timing piston. Biasing means, such as a spring, operate on the piston in opposition to the fluid force. The positioning of the timing piston is controlled by a servo-valve operating within an axial bore in one end of the timing piston and receiving a rotary input from an electric rotary actuator. A delivery passage extends in the piston from the fluid supply in the cylinder to a control orifice formed at its intersection with the side wall of the piston bore. A discharge passage extends from the piston bore to a relatively low pressure region of the pump. The electric rotary actuator is drivingly connected to a rotary shaft extending axially into the cylinder and into the piston bore, the shaft being axially stationary and having affixed thereto an occluding servo-valve surface terminating in a control edge. The occluding surface of the servo-valve prevents fluid flow through the control orifice, and the control edge is inclined to the shaft axis such that rotation of the shaft effects axial displacement of the edge relative to the control orifice in the piston bore whereby to vary flow through the control orifice to the discharge passage and thereby cause the piston to track the control edge. The control edge of the servo valve surface may be formed by a groove extending helically about the shaft axis. The electric rotary actuator may comprise a stepper motor and gearing capable of rotating the shaft through an angle which may exceed 360°. The hydraulic fluid is supplied to the end of the timing cylinder via a supply passage in the pump, which supply passage includes a restriction. The relative flow areas of the supply passage at the restriction and of the control orifice in the delivery passage determine the fluid pressure in the cylinder and therefore the balance point of the piston.

BEST MODE FOR CARRYING OUT THE INVENTION

Figure 1:
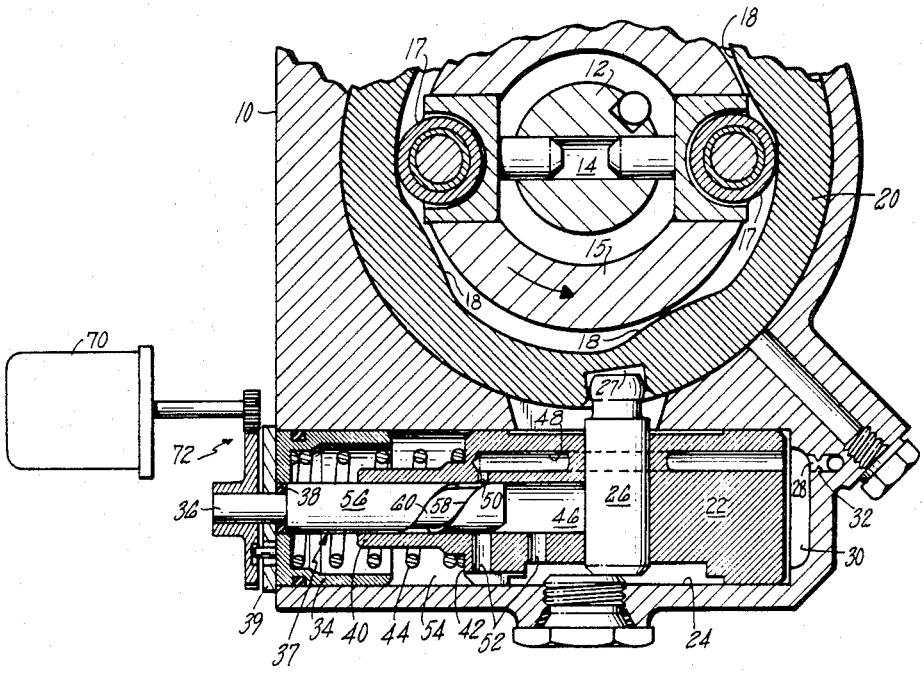
FIG. 1 is a sectional view of a fuel injection pump including the timing control mechanism of the invention.

Referring to FIG. 1, there is provided a pump body 10 in which is mounted a pump rotor 12 and rotor drive shaft 15 generally in accordance with the description of such pump contained in the aforementioned U.S. Ser. No. 226,441 of DiDomenico et al. The rotor 12 and drive shaft 15 are arranged to be driven in timed relationship with the associated engine. One or more transversely extending bores 14 in the rotor 12 house respective pairs of opposed pumping plungers 16. As the rotor 12 and drive shaft 15 rotate, the pumping plungers 16 are moved inwardly, via respective rollers 17, by the action of cam lobes 18 formed on the inner periphery of an annular cam ring 20 located within the pump body 10. Such inward motion of the plungers 16 operates in a well known manner to pressurize fuel located in the bore between the plungers and to eject such fuel from the rotor and thus the pump 10 through various ports (not shown) located along the length of the rotor 12. The fuel thus ejected is then delivered to injectors for timed injection into the engine.

As is well known, the timing of the pressurized ejection of fuel from pump 10 corresponds with the plungers being driven inward by cam lobes 18, the timing of which is dependent upon not only the angular position of rotor 12 and drive shaft 15, but also the angular positioning of cam ring 20. As is known, cam ring 20 is angularly adjustable, typically by engagement with a timing piston 22 which is located within a tangentially disposed timing cylinder 24. Connective engagement between the timing piston 22 and the cam ring 20 is provided by a pin 26 carried by the timing piston and extending into a hole 27 in the periphery of the cam ring 20. Pin 26 also serves to prevent rotation of piston 22 within cylinder 24.

In accordance with the invention there is provided an improved timing control mechanism having the characteristics and details hereinafter described. A supply pump (not shown) associated with the injection pump 10 not only supplies diesel fuel to the injection bore 14, in a known manner, but also supplies such fuel as an hydraulic fluid via supply passage 28 to the pressure chamber 30 at the innermost end of timing cylinder 24. Typically, the fluid provided by the supply pump is at a valve-regulated pressure which varies as a function of the speed at which rotor 12 and drive shaft 15 are driven. Although this speed-dependent pressure characteristic may be desirable in certain instances, it is not essential to the operation of the timing mechanism of the present invention, as will become apparent hereinafter. An annular restriction 32 is formed in the supply passage 28 and is sized such that the passage is large enough to permit ingress of fluid to the pressure chamber 30 at a rate sufficient to permit correct timing advance during engine transients, yet small enough to offer resistance to the reverse flow of fluid from that chamber that would otherwise undesirably affect timing retardation as the rollers 17 associated with plungers 16 engaged the cam lobes 18 with the rotor 12 rotating in a counterclockwise direction as shown. In the described embodiment, the I.D. of restriction 32 is in the range of 0.5–0.75 mm.

The timing cylinder 24 is formed by a blind bore in the pump housing 10, which bore has a first relatively large diameter for slidably housing the timing piston 22 and which terminates in the pressure chamber 30 of somewhat smaller diameter. The cylinder 24 is closed at its other end by a cup-shaped closure member 34 which is inserted in the end of the cylinder in sealed relation therewith and is maintained in position by a retaining flange 39 secured to the pump housing. The shaft 36 of an angularly adjustable servo valve 37 extends rotatably through the end closure 34 in coaxial relationship with the timing cylinder 24. A suitable seal, such as a resilient O-ring 38 is interposed between the servo valve shaft 36 and the closure 34 to prevent leakage of the hydraulic fluid within cylinder 24, yet afford low resistance to the angular displacement of the servo valve 37 and allow for a small degree of misalignment where the shaft of servo valve 37 passes through closure 34.

The timing piston 22 is sized for close sliding operation within the timing cylinder 24 and includes at its end adjacent the end closure 34, a neck portion 40 of reduced diameter. A shoulder 42 formed by the change in diameters of piston 22 serves as a seat for one end of a compression spring 44 which encircles the neck portion 40 and is seated at its opposite end against the end wall of end closure 34, for biasing the timing piston 22 toward a position of maximum retardation abutting the pressure chamber 30.

A bore 46 extends coaxially into neck 40 of timing piston 22. The diameter of bore 46 is sized to receive the servo valve 37. The length of bore 46 is sufficient to allow the full range of axial motion of the timing piston 22 relative to the servo valve 37, which valve is mounted so as to be axially stationary within cylinder 24.

In accordance with the invention, the timing piston 22 is provided with a fluid passage 48 which extends from that end of the timing piston adjacent the pressure chamber 30 to a circular control orifice 50 formed by radial intersection of the passage with the bore 46 in the piston. Control orifice 50 has a diameter in this embodiment of 2.5 mm. In this way, fluid delivered to the pressure chamber 30 from the supply passage 28 may then pass through the passage 48 and control orifice 50 to the piston bore 46. The area of control orifice 50 is typically a good bit greater than that of restriction 32 so as to assure good flow and control characteristics. One or more discharge passages 52 are provided from the piston bore 46 to a relatively low-pressure discharge region, as for instance region 54 of the timing cylinder 24 which exists adjacent the left end of piston 22 as viewed in FIG. 1. That low-pressure region 54 of cylinder 4 typically is connected either to the inlet side of the supply pump or to the fuel tank. Conveniently, one of the discharge passages 52 is provided by a radial bore through the wall of piston 22 diametrically opposite the control orifice 50 to subsequently permit formation of the bore which defines that control orifice. The discharge passage, or passages, 52 are sized and positioned such that fluid may exit therethrough from piston bore 46 at a sufficient rate to insure that at all times the pressure within bore 46 is substantially the same as that of the low-pressure discharge region 54.

Generally speaking, the flow rate and pressure of fluid through the supply passage 28 is sufficient, in the event the control orifice 50 were completely blocked, to displace timing piston 22 leftward to an advanced position against the opposing bias force of spring 44. At most speeds, the fluid pressure would be capable of displacing piston 22 to its fully advanced position; and even at low engine speeds where the fluid pressure may be less, it is sufficient to advance piston 22 far enough for existing operating conditions, assuming selection of an appropriate spring force. On the other hand, the area of control orifice 50 is sufficiently large that, in the event it is entirely unblocked, the maximum leftward force on piston 22 developed in the pressure chamber 30 under maximum supply flow conditions and pressures is less than the rightward biasing force of spring 44, such that the timing piston will assume the fully retarded position.

In accordance with the invention, the servo valve 37 extends coaxially into the bore 46 in timing piston 22 and includes a flow-occluding surface 56 having a diameter which is only slightly less than that of the piston bore such that it may be rotated within bore 46 yet effectively terminate fluid flow through the control orifice 50. Further, the occluding surface 56 of the servo valve includes a contoured control edge 58, beyond which the diameter of the servo valve 37 is reduced so as to afford passage of fluid thereby to the piston bore 46. In the preferred embodiment, the control edge 58 on the servo valve 37 is inclined to the axis of the valve, and is formed by machining a groove 60 into the occluding surface 56 of the valve, which groove extends helically about the axis of the valve. The width of the groove 60 exceeds the diameter of control orifice 50. The servo valve 37 is bidirectionally rotatable, as by an electrically controlled bidirectional rotary stepper motor 70 and associated gearing 72.

Figure 2:
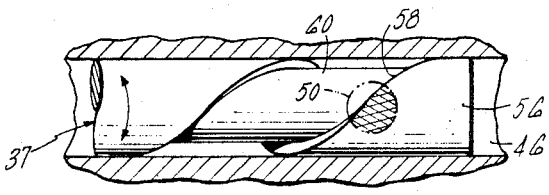
FIG. 2 is a diagrammatic top view of the control orifice and servo valve of the timing control mechanism.

The diagrammatical illustration of FIG. 2 illustrates the manner by which the rotation of servo valve 37 controls the axial positioning of timing piston 32. More specifically, the servo valve 37 and the control orifice 50 are illustrated in a so-called steady state orientation in which the occluding portion 56 of the servo valve covers a certain area of the control orifice, the covered area being shaded in FIG. 2. The remaining open area of the control orifice 50 is such as to permit a flow therethrough which results in a leftward force on piston 22 by the fluid in chamber 30 which is exactly balanced by the opposing forces of biasing spring 44. It will be appreciated that if the servo valve 37 is then rotated in either one direction or the other, as represented by the double-headed arrow, the control edge 58 will temporarily be axially displaced rightward or leftward relative to the control orifice 50 such that the open area of the control orifice is correspondingly increased or decreased. In the event the open, or flow-passing, area of the control orifice 50 is increased, there will be a greater fluid flow from pressure chamber 30 to the piston bore 46 and discharge region 54, resulting in a rightward movement of the timing piston 22 as a result of the relatively reduced pressure in the pressure chamber 30. Conversely, if the open area of control orifice 50 is decreased, the fluid pressure in pressure chamber 30 will correspondingly be relatively increased and will effect leftward displacement of the timing piston 22. In each instance, the control orifice 50, and thus the timing piston 22, are seen to track the axial positioning of the control edge 58 relative to, or in the path of, the control orifice until the steady state flow area is reestablished through the control orifice.

The length of the valve's control edge 58 in the axial direction is sufficient to permit the timing piston to be controllably positioned between the extremes of the fully advanced and the fully retarded positions. Additionally, the inclination or pitch of the helical control edge 58 relative to the axis of rotation of the servo valve 37 is selected to provide a requisite degree of control resolution. Typically, the control edge 58 may extend angularly from less than 180° to more than 360° about the servo valve's circumference, with 270° having been selected in the illustrated embodiment. Similarly, the degree of control of the angular resolution of the servo valve 37 is determined by the angular control resolution of stepper motor 70 and by the gearing 72. In the illustrated embodiment, one angular step of motor 70 results in the ring cam 20 being angularly adjusted by 1/10°.

As the rotor drive shaft 15 rotates counterclockwise, as represented by the arrow, it tends to similarly force the cam ring 20 in a counterclockwise direction, which in turn attempts to urge the pin 26 and the timing piston 22 rightward toward the maximum retard position. To aid in counteracting this effect, care is taken that it is the rightward portion of the control orifice 50 which is occluded by the occluding surface 56 of servo valve 37. By so doing, the aforementioned tendency of the piston to move rightward will further reduce the open area of the control orifice, thereby restricting fluid flow and thus increasing the leftward force on the piston by the fluid in chamber 30, so as to offset or negate the effects of rotor drive shaft 15. Were it the opposite, or lefthand, side of the control orifice 50 that was occluded, the rightward motion of timing piston 22 would serve to increase the open area of control orifice 50, thus reducing the leftward pressure of fluid in chamber 30 and in turn only serving to reinforce the undesired retarding forces caused by rotor drive shaft 15. It will be appreciated that the particular end portion of control orifice 50 (i.e. left or right) which should be occluded by the flow occluding surface 56 of the servo valve 37 is a function both of the direction of rotation of rotor drive shaft 15 and of which end of the timing piston 22 receives the driving force from the fluid pressure.

It will be appreciated that the pressure of the fluid delivered through supply passage 28 need not be a function of engine or pump speed, but rather need only be of sufficient pressure, either constant or varying, to overcome the force of spring 44 if the control orifice 50 is entirely closed, yet not so great as to permit the force of the fluid on the timing piston to overcome spring 44 when the control orifice is completely open. Within the permitted range of fluid pressures, the axial positioning of the servo valve control edge 58 relative to the control orifice 50 will serve to determine the positioning of the timing piston 22. Thus, in contrast with pump timing mechanisms of the type disclosed in the aforementioned U.S. Pat. No. 3,869,226 in which variations in the supply pressure can cause the timing piston to "float" relative to an input command position, the present mechanism permits the timing piston to be directly controlled and positioned relative to the pump housing and engine crankshaft under even conditions of varying supply pressure.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to be secured by Letters Patent of the United States is:

1. In a timing control mechanism for an engine-driven fuel injection pump, the pump being of the kind comprising a rotor, said rotor rotating in a particular direction and including a plunger located within a bore, adjustable annular cam means for effecting movement of the plunger, a fluid pressure-operable timing piston operatively connected to said cam means for adjusting the setting of the cam means to control injection timing, said timing piston operating only axially in a cylinder, said cam means being urged in said particular direction by engagement, at least indirectly, with said rotor and thereby urging said timing piston in said particular direction, fluid being supplied to an end of said cylinder for applying a force in one direction on an end of the timing piston, biasing means operating on said piston in opposition to said fluid force, and positioning means including an electric rotary actuator, for controlling the positioning of the timing piston, the improvement wherein:

said piston includes an axial bore in one end thereof, a delivery passage extending in said piston from said fluid supply in the cylinder to intersection with the sidewall of said bore at a control orifice, discharge passage means extending from said piston bore to a relatively low pressure region of the pump, and said electric rotary actuator is drivingly connected to a rotary shaft extending axially into said cylinder and into said piston bore, said shaft being axially stationary and having affixed thereto a flow-occluding valve surface terminating in a control edge, said flow-occluding valve surface preventing fluid flow through a certain portion of the total area of said control orifice in a steady-state condition and said control edge being inclined to the shaft axis such that rotation of the shaft effects temporary axial displacement of said edge relative to said control orifice in the piston bore whereby to temporarily vary flow through said control orifice to said discharge passage means and thereby cause said piston to axially track said control edge, said fluid force applied to said end of said piston being in opposition to said particular direction in which said piston is urged by said rotor and cam means, and said flow-occluding valve surface being positioned relative to said valve control edge, toward that said end of said piston receiving said fluid force such that when said timing piston is urged in said particular direction the flow through said piston control orifice is relatively reduced to relatively increase said fluid force on said piston end and thereby stabilize said timing piston.

2. The timing control mechanism of claim 1 wherein said control edge of said valve surface is helically inclined to the shaft axis.

3. The timing control mechanism of claim 2 wherein said electric rotary actuator comprises an electric motor mounted externally of said cylinder.

4. The timing control mechanism of claim 3 wherein said electric rotary actuator comprises a stepper motor.

5. The timing control mechanism of claim 2 wherein said valve-surface control edge extends angularly around a portion of the shaft circumference, said angular portion being in the range of 180°-360°.

6. The timing control mechanism of claim 5 wherein said control edge is defined by a groove in said shaft, said groove extending helically about said shaft axis.

7. The timing control mechanism of claim 1 wherein said fluid is supplied to said end of said cylinder via a supply passage in the pump, said supply passage including restriction means, the total flow area of said control orifice being greater than the flow area of said restriction means, and the flow-occluding valve surface serving to reduce the total flow area of said control orifice to such that the resulting force on said timing piston by the fluid pressure in said end of said cylinder is in balance with the opposing force of said biasing means.

8. In a timing control mechanism for an engine-driven fuel injection pump, the pump being of the kind comprising a plunger located within a bore, adjustable cam means for effecting movement of the plunger, a fluid pressure-operable timing piston operatively connected to said cam means for adjusting the setting of the cam means to control injection timing, said timing piston operating only axially in a cylinder, fluid being supplied to an end of said cylinder for applying a force in one direction on an end of the timing piston, biasing means operating on said piston in opposition to said fluid force, and positioning means including an electric rotary actuator, for controlling the positioning of the timing piston, the improvement wherein:

said piston includes an axial bore in one end thereof, a delivery passage extending in said piston from said fluid supply in the cylinder to intersection with the sidewall of said bore at a control orifice, discharge passage means extending from said piston bore to a relatively low pressure region of the pump, and said electric rotary actuator is drivingly connected to a rotary shaft extending axially into said cylinder and into said piston bore, said shaft being axially stationary and having affixed thereto a flow-occluding valve surface terminating in a control edge, said flow-occluding valve surface preventing fluid flow through a certain portion of the total area of said control orifice in a steady-state condition and said control edge being inclined to the shaft axis such that rotation of the shaft effects temporary axial displacement of said edge relative to said control orifice in the piston bore whereby to temporarily vary flow through said control orifice to said discharge passage means and thereby cause said piston to axially track said control edge, said fluid being supplied to said end of said cylinder via a supply passage in the pump, said supply passage including restriction means, the total flow area of said control orifice being greater than the flow area of said restriction means, and the flow-occluding valve surface serving to reduce the total flow area of said control orifice to such that the resulting force on said timing piston by the fluid pressure in said end of said cylinder is in balance with the opposing force of said biasing means.

9. In a timing control mechanism for an engine-driven fuel injection pump, the pump being of the kind comprising a rotor, said rotor rotating in a particular direction and including a plunger located within a bore, adjustable annular cam means for effecting movement of the plunger, a fluid pressure-operable timing piston operatively connected to said cam means for adjusting the setting of the cam means to control injection timing, said timing piston operating axially in a cylinder, said cam means being urged in said particular direction by engagement, at least indirectly, with said rotor and thereby urging said timing piston in said particular direction, fluid being supplied to an end of said cylinder for applying a force in one direction on an end of the timing piston, biasing means operating on said piston in opposition to said fluid force, and positioning means including an actuator, for controlling the positioning of the timing piston, the improvement wherein:

said piston includes an axial bore in one end thereof, a delivery passage extending in said piston from said fluid supply in the cylinder to intersection with the sidewall of said bore at a control orifice, discharge passage means extending from said piston bore to a relatively low pressure region of the pump, said actuator being drivingly connected to a shaft extending axially into said cylinder and into said piston bore, said shaft having affixed thereto a flow-occluding valve surface terminating in a control edge, said flow-occluding valve surface preventing fluid flow through a certain portion of the total area of said control orifice in a steady-state condition and said control edge being oriented to the shaft axis such that displacement of said shaft by said actuator effects temporary axial displacement of said edge relative to said control orifice in the piston bore whereby to temporarily vary flow through said control orifice to said discharge passage means and thereby cause said piston to axially track said control edge, said fluid force applied to said end of said piston being in opposition to said particular direction in which said piston is urged by said rotor and cam means, and said flow-occluding valve surface being positioned, relative to said valve control edge, toward that said end of said piston receiving said fluid force such that when said timing piston is urged in said particular direction the flow through said piston control orifice is relatively reduced to relatively increase said fluid force on said piston and thereby stabilize the timing piston.

* * * * *